US006260361B1

(12) United States Patent
Tyree, Jr.

(10) Patent No.: US 6,260,361 B1
(45) Date of Patent: Jul. 17, 2001

(54) COMBINATION LOW TEMPERATURE LIQUID OR SLUSH CARBON DIOXIDE GROUND SUPPORT SYSTEM

(76) Inventor: Lewis Tyree, Jr., 115 Liberty Hall Rd., Lexington, VA (US) 24450

( * ) Notice: Subject to any disclaimer, the term of this patent is extended or adjusted under 35 U.S.C. 154(b) by 0 days.

(21) Appl. No.: 09/431,884

(22) Filed: Nov. 2, 1999

Related U.S. Application Data

(60) Provisional application No. 60/106,898, filed on Nov. 3, 1998.

(51) Int. Cl.[7] ..... F17C 5/00
(52) U.S. Cl. ..... 62/54.1
(58) Field of Search ..... 62/48.1, 48.2, 62/49.1, 50.1, 50.5, 54.1

(56) References Cited

U.S. PATENT DOCUMENTS

| | | |
|---|---|---|
| 3,660,985 | 5/1972 | Tyree, Jr. . |
| 3,754,407 | 8/1973 | Tyree, Jr. . |
| 3,810,365 | 5/1974 | Hampton et al. . |
| 3,933,001 | 1/1976 | Muska . |
| 3,984,993 | 10/1976 | Muska . |
| 4,100,759 | 7/1978 | Tyree, Jr. . |
| 4,127,008 | 11/1978 | Tyree, Jr. . |
| 4,137,723 | 2/1979 | Tyree, Jr. . |
| 4,186,562 | 2/1980 | Tyree, Jr. . |
| 4,187,325 | 2/1980 | Tyree, Jr. . |
| 4,211,085 | 7/1980 | Tyree, Jr. . |
| 4,224,801 | 9/1980 | Tyree, Jr. . |
| 4,693,737 | 9/1987 | Tyree, Jr. . |
| 4,695,302 | 9/1987 | Tyree, Jr. . |
| 4,765,143 | 8/1988 | Crawford et al. . |
| 5,220,801 | 6/1993 | Butler et al. . |
| 5,255,523 | 10/1993 | Burgers et al. . |

OTHER PUBLICATIONS

H.C. Fisher & M.M. Reynolds "A Refrigeration System for Long Term Storage of Food Stuff @–40°C/F" IIF–IIR–Commisions D1, D2 and DC–Orlando, Fl. 1985 Fig. 3.

*Primary Examiner*—Corrine McDermott
*Assistant Examiner*—Malik N. Drake

(57) ABSTRACT

A combination liquid or slush carbon dioxide system, which receives warm carbon dioxide and then cools it to −69° F. before use, making carbon dioxide slush. The percentage of solid carbon dioxide in the slush is controlled. Slush is useful when subsequent carbon dioxide snow is being sought for refrigeration purposes. The system is versatile enough to be used successively to deliver slush and then cold liquid, or vice versa.

23 Claims, 2 Drawing Sheets

90
92
94
96
97
99
98
60
74
80
84
78
82
75
76
70
63
72
66
68
67
54
86
19
46
48
50
52
102
101
62
65
58
64
24
100
21
12
28
23
22
34
26
30
31
32
36
38
20
56
25a
25b
25
18
11
15
14
10
17
16

COMBINATION LOW TEMPERATURE LIQUID OR SLUSH CARBON DIOXIDE GROUND SUPPORT SYSTEM

CROSS REFERENCE TO RELATED APPLICATIONS

Priority for the present invention is based upon prior filed Provisional Patent Application Ser. No. 60/106,898 of Lewis Tyree, Jr. entitled COMBINATION LOW TEMPERATURE CARBON DIOXIDE LIQUID OR SLUSH GROUND SUPPORT SYSTEM filed on Nov. 3, 1998.

STATEMENT OF FEDERALLY SPONSORED RESEARCH AND DEVELOPMENT

Not Applicable

BACKGROUND OF THE INVENTION

This invention relates to the apparatus and methods suitable for liquid carbon dioxide storage and process systems typically located at customer or user sites which supply very cold liquid or liquid and solid (slush) carbon dioxide to devices which then form dry ice snow (a form of solid carbon dioxide) and useful when creating refrigeration effects. Such systems, while they may have other beneficial uses, are especially useful as ground support/filling apparatus for trucks or rail cars utilizing carbon dioxide as an expendable refrigerant for cooling.

BACKGROUND-DESCRIPTION OF PRIOR ART

Solid carbon dioxide (dry ice) has long been used as an expendable refrigerant for many cooling applications because of its ease of application, its non-toxic nature, its very large refrigeration effect when subliming, its direct change to the gas phase and its desirable low range of refrigeration temperatures. Dry ice, at atmospheric pressure, sublimes at −110° F. and has a heat of sublimation of 244 btu/lb. Dry ice typically has been made at central points in the form of blocks and then transported to the customer or using sites, stored, then placed or mixed when and where cooling was desired. In some cases, the user was sufficiently large to have an on-site dry ice machine, usually making small extrusions, called nuggets, served by an on-site supply of liquid carbon dioxide.

One early use of carbon dioxide to cool rail cars or other transport was to place already formed dry ice blocks inside an insulated portion of the car or transport container, and optionally have a thermostat controlled fan to enhance circulation and control refrigeration provision. This practice has continued today, but more directed at smaller volume units, without fans.

Today liquid carbon dioxide is typically received and stored at customer sites in insulated storage vessels under about 300 psig pressure and at a temperature of about 0° F.; and then converted, when needed, to dry ice by the customer in a variety of machines, generally characterized within the carbon dioxide industry as "dispensing devices" or "dispensing equipment". In many cooling applications, such as filling the dry ice bunker of a rail car or such, as shown in U.S. Pat. Nos. 4,704,876 (1987) to Hill, in 5,168,717 (1992) to Mowatt-Larssen and in 5,660,057 (1997) to the present inventor, the liquid carbon dioxide is piped to the rail car, then expanded inside the bunker to atmospheric pressure, where it partly turns to a solid, termed snow (a loose, non-compressed form of particulate dry ice), but with a substantial part of the liquid carbon dioxide flashing to vapor as it expands. This flash gas or vapor, at −110° F. can be used to cool the inside walls and the floor of the car as it exits the car, but its refrigeration is largely wasted. The amount of solid carbon dioxide (dry ice snow) needed to be provided in the car is determined by analysis of the intended trip, considering both en route time and ambient temperature anticipated; and the proper amount dry ice snow placed in the bunker, determined by measurement of liquid used (either by use of volumetric flow meters or timed injection into the bunker through orifices of known flow characteristics with liquid carbon dioxide), and with conversion of liquid carbon dioxide to snow calculations based upon the temperature of the liquid carbon dioxide. The dry ice snow deposited in the bunker provides the subsequent cooling needs of the rail car, subliming in the process. The use of liquid carbon dioxide at a temperature below the normal storage temperature of 0° F. is desirable in such applications because the use of such colder liquid carbon dioxide during the expansion process produces a larger percentage of solid carbon dioxide and a smaller percentage of vapor carbon dioxide, which is largely wasted; all resulting in reduced liquid carbon dioxide use and lower costs to the users. U.S. Pat. No. 3,660,985 (1972) to the present inventor represents an early method to achieve the convenience of liquid conveyance to the actual using device, but also provided improved dry ice conversion efficiency by reducing the temperature of the liquid carbon dioxide. U.S. Pat. No. 4,888,955 (1989) to the present inventor, et al, shows a different method of reducing the temperature of the liquid carbon dioxide before use. Reductions in carbon dioxide usage of up to about 20% are made possible by the use of very cold liquid carbon dioxide. In two early U.S. Pat., Nos. 3,810,365 (1974) to Hampton et al and 3,933,001 (1976) to Muska, a carbon dioxide slush (also termed a slurry or a multi-phase mixture) was created and then transported to a customer location for use. In U. S. Pat. No. 3,817,045 (1974) to Muska, a method of using slush of up to 85% solid is revealed in the manufacture of dry ice pellets (nuggets). In another early U.S. Pat., No. 3,984,993 (1976) also to Muska, a method a method of making high solid concentration carbon dioxide slush is revealed. However, the inherent problems of moving the slush mixture to many actual using devices (where the slush expands to atmospheric pressure) and the slush's use within the using device itself, were so severe and unsolved that these patents found no use. For some applications, such as shown in U.S. Pat. No. 4,695,302 (1987) to the present inventor-liquid carbon dioxide is converted to a triple point mixture and with the liquid and solid phase mixing so as to form a slush. This slush is then used to cool the liquid carbon dioxide used for snow making/bunker filling and for filling each car's individual small tank with liquid carbon dioxide. This results in the near 20% reduction stated above, with the reduction being in the amount of vapor formed. However, slush was not used in the '302 U.S. patent identified above to expand to snow in the bunker, only aiding in the production of cold liquid carbon dioxide.

While cooling carbon dioxide to low temperatures, or to the stage where slush is created may seem to be straightforward mechanical refrigeration problems and then moving the slush to a use point similar in nature to moving a water slush mixture; the highly unusual nature of carbon dioxide, and especially the problems in moving a slush mixture that instantly becomes a solid if allowed to depressurize even slightly below the triple point pressure, were such that no satisfactory solution was found. Some of the contributing problems unique to carbon dioxide usage include: 1) the fact that liquid carbon dioxide when depressurized to 75 psia (the triple point), it initially becomes a mixture of liquid and vapor; 2) as additional vapor is removed and the pressure drops, a layer of particulate solid carbon dioxide is created on the upper surface of the liquid; 3) the particulate solid carbon dioxide is heavier than the liquid, thus tends to sink to the bottom of the liquid; 4) the fact that slush carbon dioxide, when being moved, easily clogs lines at piping anomalies and at valves, etc.; and 5) subsequent pressure reduction to below the triple point due to flow induced pressure drop can cause carbon dioxide slush to turn entirely solid and block the conduit. Accordingly, most prior art inventions did not move the slush to a use point and then expand it directly to solid. Much the same type problems arose if an attempt was made to intermittently move or use liquid carbon dioxide whose condition was near the triple point.

A related problem is due to the nature of use of most expendable refrigerants, of which carbon dioxide is a member, whether used in liquid form or in solid form (dry ice). This problem is that expendable refrigerants are used precisely when the cooling is desired (or the need commences), thus the use rate can vary greatly. Low use rates can be followed by high use rates, varying quickly from no use to high use. U.S. Pat. Nos. 4,888,955 (1989) and 5,934,095 (1999) to the present inventor, et al, were directed at solving this problem when very cold liquid carbon dioxide is being used, by incorporating a storage function of previously cooled liquid carbon dioxide.

U.S. Pat. No. 5,255,523 (1993) to Burgers et al discloses a method of determining the % solid content in a slush mixture of liquid and solid carbon dioxide by adding a trace substance to the mixture. However, the carbon dioxide is not used in a dispensing device, but remains in the slush chamber. In addition, many carbon dioxide uses require high purity, and trace substances would be most objectionable.

Although some of these systems have worked well for individual applications involving chilled liquid carbon dioxide, there are none involving slush carbon dioxide (offering the greatest carbon dioxide use efficiency). Accordingly, they have not solved the most needed problems, and consequently improvements in this area are sought.

SUMMARY OF THE INVENTION

The present invention provides methods and systems for safely receiving liquid carbon dioxide at a range of temperature/pressures into a storage system that, by pressure and temperature manipulation is subsequently able, prior to further use, to increase the liquid carbon dioxide's refrigeration potential to the extent desired by reducing its temperature and/or causing part to become solid and form a slush mixture of desired solid-liquid proportions, and to store this product so it is available for ready use. As such, its principal objective is to increase the efficiency of liquid carbon dioxide conversion to snow and thereby reduce the cost of carbon dioxide cooling, but also retain the convenience of liquid carbon dioxide supply to the dispensing device or equipment.

In one aspect, it can create a mixture of solid and liquid carbon dioxide, to the pre-determined desired proportions of each, and to store this product so it is available for ready use, and to maintain it during storage until used in the predetermined desired proportions of liquid to solid. It also manages the mixture during its creation and its subsequent movement, so that it remains sufficiently fluid to be conveyed by piping to the desired use point and through the dispensing device as and when needed. Since the precise geometry and flow characteristics of each carbon dioxide expansion valving arrangement and conduit contained in dispensing devices, and the piping between it and the slush chamber are different, not only can the proportion of solid in the slush be varied as needed by such equipment and the arrangement and conduit specifics, but if an inadvertent dry ice blockage occurs, the present invention has the ability to quickly clear the blockage by melting the dry ice, using either vapor or liquid. The invention thus provides a method of creating desired proportions of solid to liquid in the slush mixture and also a method of creating and maintaining the homogeneity of a slush mixture during and after it has been created. It is most desirable to be able to produce the desired proportions of solid and liquid in the slush mixture so as to be able to also accurately predict the amount of snow produced from a given amount (weight and/or volume) of slush. If not, the usage of the slush mixture can not be accurate, and either too much or too little can be used, thus not providing the needed cooling or wasting cooling and thus carbon dioxide.

In another aspect, lower temperature/pressure liquid carbon dioxide is available to fill small on-board, transportable tanks for subsequent truck or rail car or container cooling.

In still another aspect, very low temperature (near −70° F.) liquid carbon dioxide can be available for filling dry ice bunkers in rail cars or containers, such as in U.S. Pat. Nos. '876 and '717, earlier identified, where rail cars or containers cannot accept slush carbon dioxide because of their arrangement/conduit configuration.

In still another aspect, slush carbon dioxide can be available for accurately filling dry ice bunkers in rail cars, containers or trucks, such as shown in U.S. Pat. No. 4,186,562 (1980) to the present inventor.

In a different application of these aspects, lower temperature/pressure liquid or slush carbon dioxide is available to food mixers and like cooling devices.

Various and different use rates and amounts are needed for these different applications. As an example, filling a rail car bunker with about 9,400 lbs. of dry ice can require about 20,000 lbs. of liquid carbon dioxide at about 0° F. within a 30 minute period (releasing about 11,600 lbs. of vapor); or about 16,000 lbs. of liquid carbon dioxide at about −65° F. within the same 30 minute period (releasing about 6,500 lbs. of vapor), and a reduction in carbon dioxide usage of about 20%; or about 12,200 lbs. of a 50% liquid/50% solid mixture by weight slush carbon dioxide within the same 30 minute period (releasing about 2,800 lbs. of vapor), and a reduction in carbon dioxide usage of about 39%; or about 11,000 lbs. of a 25% liquid/75% solid mixture by weight slush carbon dioxide within the same 30 minute period (or different if desired) and releasing about 1,600 lbs. of vapor and a reduction in carbon dioxide usage of about 45%. A mixer for blending meats can require 500 lbs. of dry ice in 5 minutes (and with the same proportions of carbon dioxide at the different conditions as for the rail car above); but there can be a number of purposeful interruptions/delays during the use of the carbon dioxide, as these often are batch processes controlling the temperature of an active mixture as different temperature ingredients are added. Accordingly, an important aspect of the invention is the ability to intermittently cycle small amounts of carbon dioxide liquid or slush to the mixer (dispensing device).

While the utility of the invention has been described with respect to certain applications, the variety of it's capabilities is such that many liquid carbon dioxide applications, where carbon dioxide snow/dry ice is involved as the final carbon dioxide condition, could be well served by a variation or combination of these aspects. One special advantage is that the size of the storage vessel and the size of the processing vessel are independent of each other and the size of the compressor and/or refrigeration unit(s) are also independent. This allows selection of the receiving storage vessel's size to include distribution economies; selection of the processing vessel's size and to include use patterns, and selection of the compressor and/or refrigeration units' size to include individual user needs.

Accordingly, the system is modular, and able to be readily adapted to meet virtually all the different user's requirements, but without the burden of a custom engineered system and design.

BRIEF DESCRIPTION OF THE DRAWINGS

For purposes of simplifying the figures, some lines/connections to the storage vessel standardly provided in the carbon dioxide industry have been omitted, such as fill lines, auxiliary liquid and vapor lines, safety relief valves, level/contents device, pressure gauge, clean-out and others.

DETAILED DESCRIPTION OF THE PREFERRED EMBODIMENTS

Note: In all drawings where carbon dioxide flow is shown, a single headed arrow→indicates vapor flowing; a two headed arrowindicates liquid flowing. Where slush is shown in section, a wavy liquid line above triangles is used

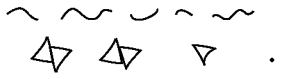

Figures 1A, 1B:
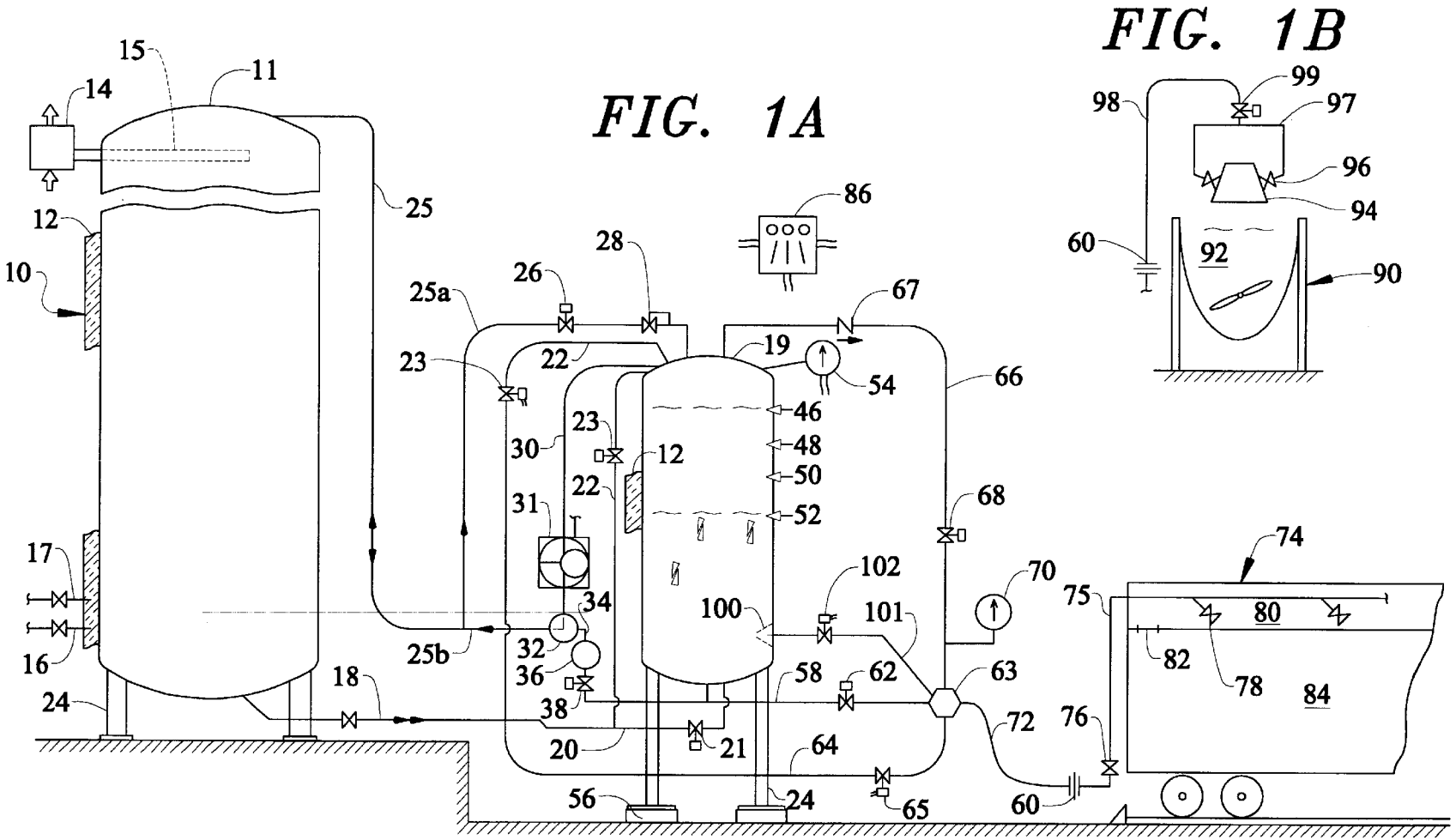
FIG. 1A is a diagramatic/schematic view of a system embodying various features of the invention with portions broken away and with a number of components shown schematically, with the invention as used to deliver slush carbon dioxide to the dry ice i.e. snow making device(s) inside the bunker of an insulated rail car.
FIG. 1B is a view of the system of FIG. 1A, but connected to some other dispensing device such as a mixer, and delivering slush carbon dioxide as needed.

Illustrated in FIG. 1A is a system to be located at a user's site capable of delivering either very cold liquid or slush carbon dioxide to various types of dispensing devices at various equilibrium conditions, generally between about 60 psig and −69° F. and about 300 psig and 0° F. (depending upon the type device and the pressures desired when using each), but shown delivering slush. The system preferably includes either a vertically oriented vessel system 10, with an inner vessel 11 having a height greater than its interior width and being sized to hold a reservoir of liquid carbon dioxide sufficient for the customer needs, such as those using liquid carbon dioxide for truck or rail car cooling or users benefiting from the use of very cold liquid or slush carbon dioxide. Vessel 11 is provided with suitable insulation 12 so as to maintain the temperatures therewithin at temperatures below 0° F. Vessel 11 is made from metals, or other materials suitable for both the temperatures and pressures anticipated. While vertical vessels are generally preferred because of a smaller footprint, a horizontal vessel can be substituted (and a great number exist).

In use, liquid carbon dioxide is typically supplied to vessel 11 by truck or rail, so as to create a reservoir of liquid carbon dioxide therewithin. Following the initial filling of vessel 11, this reservoir of liquid carbon dioxide will generally be at about equilibrium temperature and pressure conditions throughout, for example about 0° F. and 300 psig or about −20° F. and 225 psig or intermediate conditions. Past practice has been to maintain these conditions by the provision of a standard freon type refrigeration unit 14 providing its refrigeration output to built-in coils 15 located in the upper vapor space of vessel 11. More current practice for vertical vessels (and favored for use with this invention) would be to provide both the coils and refrigeration unit outside the vessel 11 (not shown), as in U. S. Pat. No. 5,934,095 (1999) to the present inventor. Refrigeration unit 14 typically contains a freon type compressor, a condenser, which is cooled by ambient air forced through it by a fan, expansion valve and control panel, which turns on the refrigeration unit when the carbon dioxide pressure in vessel 11 becomes too high and turns off when it becomes low. Other normal devices normal to such refrigeration units are used but not specifically identified. While a freon type refrigerant is stated as the refrigerant of choice, there are other alternatives that may be preferred and would operate satisfactory.

Still referring to FIG. 1, vessel 11 is filled with liquid carbon dioxide from a delivery vehicle (not shown) through liquid fill system 16, with a fill-vapor return system 17 relieving excess pressure occurring in vessel 11 during fill, and in the process also scavenging air and non-condenseables that may have collected from the top of vessel 11 through a vapor scavenger (not shown).

These non-condenseables will then return to the shipping point via the delivery vehicle for proper disposition. Fill system 16 can be divided into sub lines as desired, i.e. one to the top and one to the bottom of vessel 11 as well as one or more intermediate entry lines (not shown), so as to provide ease of filling and control of the temperature/pressure of the liquid carbon dioxide in vessel 11 during filling operations. A liquid withdrawal line 18 is provided for supplying process vessel 19 with liquid carbon dioxide or for other customer use. Vessel 19 is located as near as possible to the final carbon dioxide dispensing point, so as to simplify the piping between the final use point and itself and thus minimize the opportunity for slush blockages, and thus vessel 19 may be some distance from system 10. Branch line 20 connects liquid line 18 to the bottom of vessel 19 and contains control valve 21. Branch line 22 connects liquid line 18 to the top of vessel 19 and contains control valve 23. A safety relief line, having a number of safety related functions connects to the top of vessel 11 and a similar relief line connects to the top of the vessel 19 (not shown). Vessels 11 and 19 are surrounded by insulation 12, and each is supported on legs 24. As stated previously, not shown for clarity's sake are the standard additional lines and devices provided on such pressurized liquid carbon dioxide storage vessels, for instance safety items, level/contents/ pressure indicators, pressure building connections, duplicate liquid and vapor lines, vacuum readout-if appropriate and other similar items.

Vapor line 25 connects the ullage volumes of vessels 11 and 19. Vapor may flow in both directions in line 25, and in some cases it may be desirable to provide separate lines. Control valve 26 and downstream regulator 28 are located in line 25*a*. Vapor withdrawal line 30 connects the upper (ullage) volume of vessel 19 to booster compressor (and motor) 31. Compressor 31 discharges to three way valve 32. In one position, valve 32 connects back to line 25 via line 25*b*; in the other position it connects to alternate discharge line 34 which is connected to the bottom of vessel 19. In line 34 are receiver 36 and control valve 38. Level monitors/switches 46, 48, 50 & 52 are used with vessel 19 at points that allow the known reduction in volume of liquid carbon dioxide as it becomes a mixture of liquid and solid (slush) to make an accurate determination as to the percent solid and percent liquid carbon dioxide in the slush, as will be explained later (as well as alternate methods of such determination). Pressure switch 54 senses and monitors the pressure in vessel 19. The legs 24 of vessel 19 rest upon weight cells 56, allowing determination of the weight of the process vessel and its carbon dioxide contents as desired, as will be explained later, and so that an accurate determination of the amount of liquid or slush carbon dioxide delivered to the dispensing device can be made. Slush discharge line 58 connects to the bottom of vessel 19 and to chamber 65 and line 58 includes control valve 62. Branch line 64 connects line 18 with chamber 63 and contains control valve 65. Line 66, containing check valve 67, control valve 68 and pressure switch 70, connects the ullage volume of vessel 19 to chamber 63. Loading connection hose 72 connects chamber 63 with rail car connection 60. Car 74 includes conduit/manifold 75, and includes shut off valve 76 and terminates with automatic expansion valves 78. Expansion valves 78 can be the pressure responsive automatic shut-off type widely used in the carbon dioxide industry, i.e. PRASO valves. Valves 78 are located in the dry ice (snow) bunker 80 of the carbon dioxide dispensing device, car 74. For frozen foods, typically vents 82 connect bunker 80 with cargo volume 84, so the cooling available from the flash carbon dioxide vapor is usefully employed in cooling before venting to the atmosphere. A car vent for this purpose (not shown) is typically included in car 74.

Process control panel 86 monitors and controls the various elements of the entire process as selected by the user. By use of this arrangement, carbon dioxide vapor can be withdrawn from the vessel 19, raised in pressure by compressor 31, and then returned either to the vessel 11 or returned to the bottom of the vessel 19, all as determined by the logic of the control panel 86. While for ease in depiction, compressor 31 has been depicted as a non-lubricated (oiless) rotary vane compressor, any suitable type can be used; and all control devices could be replaced with other types, such as electronic. Filters etc. can also be included as desired.

FIG. 1B substitutes a mixer 90 for rail car 74 of FIG. 1A, containing meat 92, or the like, which it is desired to cool as the mixing occurs. A snow horn 94 is positioned above the meat 92. Slush compatible valves 96 (such as PRASO valves) are supplied with slush by conduit/manifold 97 and supplied with liquid, slush or vapor carbon dioxide by line 98, containing control valve 99. Line 98 then connects to chamber 60 so as to receive carbon dioxide for use in mixer 90.

While not utilized in the production or transfer of slush, screen 100 is inserted inside the lower portion of vessel 19, and line 101, containing control valve 102, connects the inside of screen 100 with chamber 63, so that very cold liquid carbon dioxide may be removed from vessel 19 without removing slush, as will be explained later.

Figures 2A, 2B, 2C:
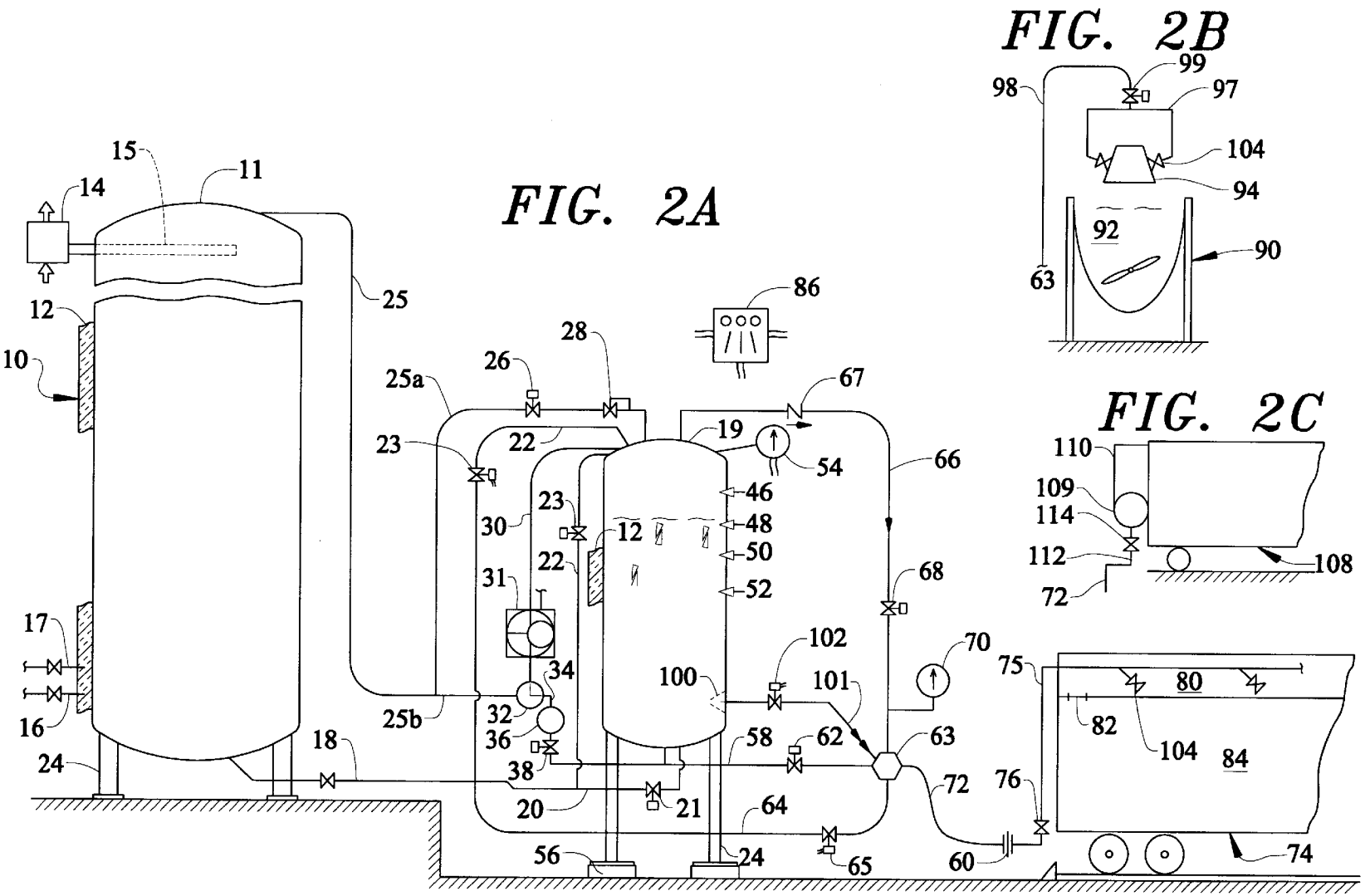
FIG. 2A is a view of the system of FIG. 1A, but delivering very cold liquid carbon dioxide to the dry ice making device(s) inside the bunker of a rail car
FIG. 2B is a variation of FIG. 2A but delivering very cold liquid carbon dioxide to some other dispensing device, such as a mixer.
FIG. 2C is a variation of FIG. 2A, but delivering cold liquid carbon dioxide (about −45° F.) to a tank carried on a truck for subsequent cargo cooling, the carbon dioxide cooling the truck either with an indirect or direct process.

FIG. 2A is the same system as FIG. 1A, except that the expansion valves 78 in car 74 have been replaced with expansion devices or orifices 104, which are unable to handle slush carbon dioxide, and thus must be supplied with only liquid, but cold liquid is an advantage. A number of cars 74 were constructed in this fashion.

FIG. 2B is the same system as FIG. 2A, but substitutes mixer 90 for the rail car 74. However, slush compatible expansion valves 96 have been replaced with expansion devices or orifices 104 unable to handle slush carbon dioxide, and thus must be supplied with only liquid, but cold liquid is an advantage. Line 98 connects to chamber 63 (not shown). A number of mixers 90 are constructed in this fashion.

FIG. 2C is the same system as FIG. 2A, but substitutes refrigerated trailer/truck 108 for the rail car 74. In addition, this arrangement supplies liquid carbon dioxide at about 125 psig to a small tank 109 carried in the truck expendable liquid carbon dioxide cooling system 110, and later utilized to cool the cargo space of truck (not shown). Line 112, containing fill valve 114, connects tank 109 to hose 72 when filling is desired.

Turning next to the operation of the systems of FIGS. 1A and 1B, process vessel 19 has being filled with warm liquid carbon dioxide from vessel 11 up to level switch 46 by line 20, as controlled by valve 21, or alternately by line 22, as controlled by valve 23; and influenced by compressor 31 operating and returning vapor through valve 32 and lines 25*b* and 25 to vessel 11. Compressor 31 then continues to operated, with the vapor passing through valve 32 and lines 25*b* and 25 to vessel 11. As the liquid level drops (and the pressure) in vessel 19, additional liquid is added until the triple point pressure is reached (about 60 psig) so that vessel 19 contains triple point liquid at level 46. If vapor continues to be removed, slush forms, and the density increases. If a slush mixture of about 25% solid is desired, vapor removal ceases when the level reaches switch 48, located appropriately. As compressor 31 operates, particles of dry ice form on the upper surface of the liquid carbon dioxide within vessel 19. If the rate of vapor withdrawal is slow enough, the dry ice particles with gradually sink to the bottom of vessel 19. If not, flow from compressor 31 can be momentarily stopped; or alternately, rapidly cycling valves 34 and 38 on and off, causing the slush to be agitated by intermittent vapor injection. In addition, a mechanical mixing device (paddle or other type) can be used (not shown). Since the solid is denser than the liquid, as vapor is removed and ice is formed, the liquid level drops by more than the volume of liquid removed as vapor. This difference is utilized in this aspect to determine the percentage solid in the slush mixture and to appropriately locate switches 48, 50 and 52. Different dispensing devices can tolerate different slush percentage solids. In this case, (as an example), it has been determined that when the slush level has dropped to level switch 52, the desired percentage solid (75) is present, compressor 31 is stopped; and transfer of the slush can begin.

Since the density of the slush mixture is a measure of the percentage solid, the apparatus of FIG. 1A can be utilized in an alternate method to determine that percentage by maintaining the slush mixture at a given level, as vapor is being removed from vessel 19, and monitoring the weight of the slush in vessel 19 by means of cells 56. The density of triple point liquid is about 73 lbs./cu. ft.; of 25% solid in slush, about 77 lbs./cu. ft.; of 50% solid in slush, about 82 lbs./cu. ft.; of 75% solid in slush, about 87 lbs./cu. ft. With the known volume and weight of the slush, an accurate determination and control of the solid percentage can be made by panel 86, as selected by the operator.

After vessel 19 contains the selected percentage solid of slush, it will be injected into car 74. Compressor 31 will be stopped and valve 26 opened, allowing vapor from vessel 11 to enter vessel 19, at a pressure set by regulator 28. While it is desired to have sufficient counter pressure to eject the slush from vessl 19, too high a pressure warms the top layer of slush. Valve 68 is also opened allowing vapor at slightly less than the pressure of regulator 28 to pressurize line 66 and manifold 75. The spring resistence of check valve 67 determines how much less the pressure in line 66 is than that in the vessel 19. Pressure switch 70 monitors this pressure and does not allow valve 62 to open to begin flow until the pressure in line 66 is at least about 2 psi above the triple point pressure. Again, these exact figures are determined by the geometry of the piping connecting vessel 19 and expansion valves 78. Long radius elbows,straight runs, full opening valves such as ball valves, etc. are preferable for slush flow. Once a suitable pressure has been reached and valve 62 opened, flow of slush begins, and valves 78 open and snow making in the bunker 80 begins. In this type car, this flash vapor passes through vents 82 in the floor of bunker 80 , around the cargo and then to vents to the atmosphere (not shown). If desired, a pump (not shown) can be utilized in line 58 to aid in flow of the slush.

In order to determine the amount of snow placed in bunker 80, the percentage solid in the slush mixture (as determined by one of the methods above) and the weight of the delivered amount (as determined by cells 56) and the known conversion factor of that percentage solid in the slush, to snow are integrated together, and flow stopped by closing valves 62 and 68, as controlled by panel 86.

Turning next to the operation of FIGS. 2A, 2B, and 2C, vessel 19 is assumed to have been filled with an appropriate amount of slush, but of the 25 percentage solid type. Inasmuch as the purpose of this mode is to deliver cold liquid, slush does not leave vessel 19. When filling of bunker 80 of FIG. 2A is to begin, valve 26 is opened, allowing the pressure in vessel 19 to increase over the triple point pressure. Next, valve 68 is opened, maintaining a pressure at least about 2 psi above the triple point pressure throughout the conduit. Next, valve 102 is opened and flow of liquid from vessel 19 commences (solid cannot pass through screen 100. Once the desired amount has been delivered to car 74 (determined in the same fashion as with slush), valves 102 and 68 are closed.

Operation of FIG. 2B is identical to that of FIG. 2A.

Operation of FIG. 2C is different, as it is desired to deliver liquid carbon dioxide at about −45° F. and about 125 psig. First, vessel 19 must be brought to a pressure slightly above 125 psig. Next, a temperature sensor in chamber 63 (not shown) causes panel 86 to adjust the flow of very cold liquid through line 101 by modulating valve 102 and adjust the flow of warm liquid through line 64 by modulating valve 65, so as to achieve the desired temperature liquid carbon dioxide for filling tank 109. If desired, unit 110 can be operated to assist in filling tank 109.

The configuration of the system is such that an operator can switch back and forth from delivering cold liquid to delivering slush, an advantage for frozen food shipping points utilizing different types of transport equipment.

In all cases where valves or switches are said to be operated, this function would be controlled by panel 86. Liquid or vapor carbon dioxide lines are shown in the manner simplest to illustrate. In actual practice, lines may be combined or separated Although the invention has been described with regard to what is believed to be the preferred embodiment, changes and modifications as would be obvious to one having ordinary skill in both refrigeration and carbon dioxide art can be made to the invention without departing from its scope Particular features are emphasized in the claims that follow The term conduit used in the following claims is to be interpreted broadly to include pipe, tube, valve, pump and other devices used in the transfer of fluid, vapor or slush. The term slush used in the following claims is to be interpreted as a Mixture of solid and liquid carbon dioxide.

I claim:

1. A ground support system designed to deliver carbon dioxide to a carbon dioxide using device, for use as a cooling agent, which system comprises:

an insulated first vessel for receiving and storing carbon dioxide liquid from a vehicle, first conduit means for supplying said liquid to said first vessel from said vehicle, an insulated second vessel for receiving said liquid or carbon dioxide vapor from said first vessel and for creating, accumulating and storing carbon dioxide cold liquid and slush to be supplied to said using device, second conduit means for the transfer of said liquid and of said vapor between said first vessel and said second vessel, a mechanical refrigeration system for condensing said vapor from said system when the pressure in said system exceeds a chosen figure, refrigeration means associated with said second vessel to cool said liquid therewithin or to create said slush therewithin, by removal of said vapor, measurement means for determining the density and amount of said cold liquid or of said slush within said second vessel, mixing chamber means for combining as desired said liquid, said cold liquid or said vapor or said slush in preselected proportions or preselected sequence, third conduit means connecting said first and second vessels to said chamber means, fourth conduit means for delivering said carbon dioxide in whichever form selected and refrigeration content selected and sequence selected to said using device from said chamber, means for operating and controlling said system so as to produce said liquid carbon dioxide at a desired temperature, or slush at a desired proportion of solid to liquid, or have vapor carbon dioxide available at a desired pressure, or to maintain the homogeneity of the slush, and for transferring said slush, said liquid, or said cold liquid or said vapor in any desired proportion, amount, and refrigeration content, and in any desired sequence said slush, said liquid, said cold liquid or said vapor to said using device, whereby, either said slush or said vapor or said liquid or said cold liquid of known refrigeration content and in known quantities and in known sequence can be delivered as desired to said using device as slush, vapor, cold liquid or liquid carbon dioxide or in a combination of each, or separately, and in any desired sequence, and whereby carbon dioxide at optimus flow and desired refrigeration conditions can be supplied to different using devices, and said conditions can be modified while said using devices are being supplied without cessation of flow.

2. The apparatus of claim 1 wherein said first conduit and said first vessel includes means to scavenge air and other non-condenseables from the top of said first vessel and returning it to said vehicle delivering said liquid to said first vessel, whereby said air and other non-condenseables are removed from said system at the time of each replenishment with said liquid.

3. The apparatus of claim 1 wherein said second vessel includes means to agitate slush therein by injecting said vapor or said liquid into the bottom of said second vessel, whereby said slush can be maintained in a near homogeneous state.

4. The apparatus of claim 1 wherein means are included to pressurize said fourth conduit and the carbon dioxide conduit of said using device to a pressure at least 2 psi above the triple point pressure of carbon dioxide with said vapor before transfer of any said slush or said cold liquid to said using device, whereby the initial flow of said slush or said cold liquid is not impeded by the formation of dry ice in any conduit it is subsequently flowing through.

5. The apparatus of claim 1 wherein means are included in said chamber so that said chamber can receive said liquid from said first vessel, said slush from said second vessel, said cold liquid from said second vessel and said vapor from said first vessel, passing through said second vessel, combined as desired, and in the sequence desired, and provide the same to said using device, whereby said liquid, said cold liquid, said vapor or said slush can be provided to said using device in the desired proportions and in the desired sequence.

6. The apparatus of claim 1 including means wherein the density of said slush within said second vessel is determined by determining both the volume of said slush and the weight of said slush, whereby direct and non-additive methods are utilized to monitor and control the percentage solid in the slush.

7. The apparatus of claim 1 wherein said mechanical refrigeration system has its carbon dioxide vapor condensing coils within said first vessel's upper volume, whereby carbon dioxide vapor may be directly condensed within said first vessel.

8. The apparatus of claim 1 wherein said mechanical refrigeration system removes the vapor to be condensed, condensing it outside either said first or said second vessel, and returning it to said ground support system as carbon dioxide liquid, whereby either said first or second vessel may be of the type without internal condensing coils.

9. A method of receiving carbon dioxide liquid and cooling said liquid to the extent that either slush or carbon dioxide cold liquid or carbon dioxide vapor can be supplied to a using device as a cooling agent, comprising the steps of:

(a) receiving and storing said liquid in a first insulated vessel, (b) supplying said liquid to a second insulated vessel, (c) condensing carbon dioxide vapor exceeding a chosen pressure, (d) cooling said liquid in said second vessel to the extent that said slush or said cold liquid is formed, (e) mixing either said slush or said cold liquid or said liquid carbon dioxide or an intermediate temperature liquid carbon dioxide or vapor as desired, (f) delivering said mixture to a carbon dioxide using device, (g) measuring and controlling said receiving, said storing, said supplying, said condensing, said cooling, said mixing and said delivering, whereby either said vapor or said liquid or said cold liquid or said slush of a known refrigeration content and in known quantities and in known flow characteristics and in known sequence can be delivered as desired to said using device, as said vapor, said liquid, said cold liquid or said slush, or in a combination of each, or separately, and in a desired sequence, and whereby carbon dioxide at optimus flow and refrigeration conditions can be supplied to each using device, and said conditions can be modified while being so supplied.

10. The method of claim 9 comprising the additional step of once said second vessel contains a body of slush, supplying said cold liquid to a using device at the same time that said liquid is being supplied from said first vessel to said second vessel, whereby a much greater quantity of said cold liquid may be supplied to said using device than that quantity stored in said second vessel.

11. The method of claim 10 comprising the additional step of supplying warmer liquid carbon dioxide from said first vessel to said chamber, whereby said cold liquid carbon dioxide can be warmed to a desired intermediate temperature.

12. The method of claim 9 comprising the additional step of agitating said slush in said second vessel so that said slush remains in a homogeneous mass, whereby slush with consistent flow properties may be supplied to said using device.

13. The method of claim 12 comprising the additional step of causing said agitation by injecting said vapor or liquid into the bottom of said second vessel, whereby slush stored in said second vessel can be agitated without the use of mechanical devices.

14. The method of claim 13 comprising the additional step of injecting said vapor in periodic bursts, whereby the agitation effect of said vapor injection is increased.

15. The method of claim 1 comprising the additional step of supplying said vapor at a pressure of at least 2 psi above carbon dioxide's triple point pressure to any conduit used for delivery of said slush or cold liquid before either said cold liquid or said slush is released into said delivery conduit, whereby either said cold liquid or said slush do not form dry ice in said conduit during delivery to said using device while flowing from said second vessel.

16. A ground support system designed to receive carbon dioxide liquid and convert it to slush or carbon dioxide cold liquid, capable of supplying said slush or said cold liquid or carbon dioxide vapor, in combination or separately, and in sequence, as desired, to a using device, for use as a cooling agent, which system comprises, an insulated vessel, including conduit means, for receiving said vapor or said liquid, liquid level measurement means of the level of either said liquid or said slush within said vessel, means to weigh said vessel and its contents, refrigeration means, including second conduit means, which removes vapor from said vessel, thereby causing said liquid therewithin to change to said cold liquid and said slush, separating means in the lower portion of said vessel to create a region where said slush cannot enter, but said cold liquid can, third conduit means, one portion of which connects to that part of said vessel arranged to contain only said cold liquid and one portion connects that part of said vessel arranged to contain said slush, and one portion of which connects to said liquid, where mixing of said slush, of said cold liquid, of said liquid may occur, as desired, measurement and control means for said system, whereby slush with known refrigeration properties and flow characteristics can be created in said vessel, and then supplied to a using device singly or in combination and in any sequence, as desired.

17. The apparatus of claim 16 wherein said vessel includes means to agitate said slush therein by injecting said vapor into said slush near the bottom of said vessel, whereby said slush can be maintained in a near homogeneous state.

18. The apparatus of claim 16 wherein means are included to pressurize said third conduit to a pressure at least 2 psi above the triple point pressure of carbon dioxide with carbon dioxide vapor before transfer of said slush or said cold liquid to said using device, whereby the initial flow of said slush or said cold liquid to said using device is not impeded by the formation of dry ice in any conduit they subsequently flow through.

19. The apparatus of claim 16 wherein means are included in said third conduit so that said slush or said cold liquid or said vapor may be combined as desired, and in the sequence desired for provision to said using device, whereby slush or cold liquid or vapor may be provided to a using device having the desired refrigeration properties and flow characteristics, and in the desired sequence.

20. The apparatus of claim 16 wherein means are included in said vessel and sid controls, to determine the slush density by determining both the volume and the weight of said slush, whereby direct and non-additive methods are utilized to monitor and control the percentage solid in said slush.

21. The method of depositing dry ice in a bunker of a cargo carrying vehicle, including but not limited to rail cars, trucks and containers, said dry ice to be used for the subsequent cooling of said cargo, comprising the steps of:

(a) creating a slush mixture of solid and liquid carbon dioxide within a vessel, (b) utilizing a conduit to convey said slush from said vessel to said bunker, (c) maintaining the pressure in said conduit to at least 2 psi above carbon dioxide's triple point pressure, (d) expanding said slush to near atmospheric pressure so as to deposit said dry ice in said bunker, whereby both the convenience of conveying liquid carbon dioxide to a bunker within a vehicle by means of conduit, and the conversion to dry ice efficiency of utilizing slush carbon dioxide are provided.

22. The method of claim 21 comprising the additional step of:

determining the weight of the carbon dioxide contents of said vessel during the period of time that said slush is being utilized for depositing dry ice in said bunker, whereby the weight of said slush can be determined during the period that said slush is being utilized, and the amount of said slush used being managed.

23. The method of claim 22 comprising the additional step of:

determining the proportion of liquid carbon dioxide and solid carbon dioxide comprising said slush mixture within said vessel before and while said slush is being utilized for depositing said dry ice in said bunker, whereby the amount of dry ice to be deposited within said bunker by said slush expanding can be determined and controlled, and whereby the pre-determined amount of dry ice required for the desired cooling enroute of said cargo can be deposited in said bunker.

* * * * *